US007249542B2

(12) United States Patent
McNatt

(10) Patent No.: US 7,249,542 B2
(45) Date of Patent: Jul. 31, 2007

(54) SELF-ADJUSTING VARIABLE GRIP LOCKING PLIER FOR GRIPPING A WORKPIECE

(76) Inventor: Stanley L. McNatt, 5915 Guettermann Ehler Rd., Muldoon, TX (US) 78949-5131

( * ) Notice: Subject to any disclaimer, the term of this patent is extended or adjusted under 35 U.S.C. 154(b) by 0 days.

(21) Appl. No.: 11/302,671

(22) Filed: Dec. 14, 2005

(65) Prior Publication Data

US 2007/0131068 A1 Jun. 14, 2007

(51) Int. Cl.
*B25B 7/12* (2006.01)
*B25B 7/16* (2006.01)
*B25B 5/12* (2006.01)

(52) U.S. Cl. ..... 81/367; 81/368; 81/370

(58) Field of Classification Search ..... 81/300, 81/313–315, 318–324, 329, 331, 333, 337–340, 81/355–380
See application file for complete search history.

(56) References Cited

U.S. PATENT DOCUMENTS

| | | | | | |
|---|---|---|---|---|---|
| 2,475,866 | A | * | 7/1949 | Ward et al. | 81/331 |
| 2,838,972 | A | * | 6/1958 | Heald | 81/339 |
| 2,914,979 | A | * | 12/1959 | Weinstein | 81/111 |
| 3,104,571 | A | * | 9/1963 | Trybus | 81/380 |
| 3,169,307 | A | * | 2/1965 | Langwell | 29/229 |
| 3,210,844 | A | * | 10/1965 | Todor | 30/250 |
| 3,354,759 | A | * | 11/1967 | Cook | 81/379 |
| 3,379,079 | A | * | 4/1968 | Cutter | 81/367 |
| 3,672,245 | A | | 6/1972 | Hoffman | |
| 5,022,290 | A | | 6/1991 | Duffy | |
| 5,609,080 | A | | 3/1997 | Flavigny | |
| 6,095,019 | A | * | 8/2000 | Warheit et al. | 81/370 |
| 6,212,978 | B1 | | 4/2001 | Seber et al. | |
| 6,279,431 | B1 | | 8/2001 | Seber et al. | |
| 6,408,724 | B1 | * | 6/2002 | Whiteford | 81/367 |
| 6,578,452 | B2 | | 6/2003 | Duffy | |
| 6,694,848 | B1 | * | 2/2004 | Flavigny | 81/413 |
| 6,748,892 | B1 | | 6/2004 | Seber et al. | |
| 6,862,962 | B1 | * | 3/2005 | Delbrugge et al. | 81/405 |
| 7,146,887 | B2 | * | 12/2006 | Hunter | 81/367 |

OTHER PUBLICATIONS

Photocopy of advertisement from package for which 8-in. Cam-Assisted tool was sold by Sears, Roebuck an Co. on or about Oct. 2004.

* cited by examiner

*Primary Examiner*—David B. Thomas
(74) *Attorney, Agent, or Firm*—Richard L. Miller

(57) ABSTRACT

A self-adjusting variable grip locking plier for gripping a workpiece. The plier includes a body, a handle, and a wedge. The plier is designed for extremely fast set up and for easily gripping and holding the workpiece with one hand with absolutely no adjustments ever to make, and provides a larger than ordinary jaw capacity in a very compact design. The plier grips and holds the workpiece with a light or tremendous gripping force with no adjustments ever to make, and with an extremely fast unlocking system, while at the same time fitting into the palm of one hand. When the workpiece is grasped, one simply ratchets the handle until the desired grip is obtained. The more times one squeezes the handle the tighter the grip. This automatically locks the plier at the desired grip. To release the plier one simply pushes the wedge back into the body with the palm of one hand.

135 Claims, 6 Drawing Sheets

FIG. 1
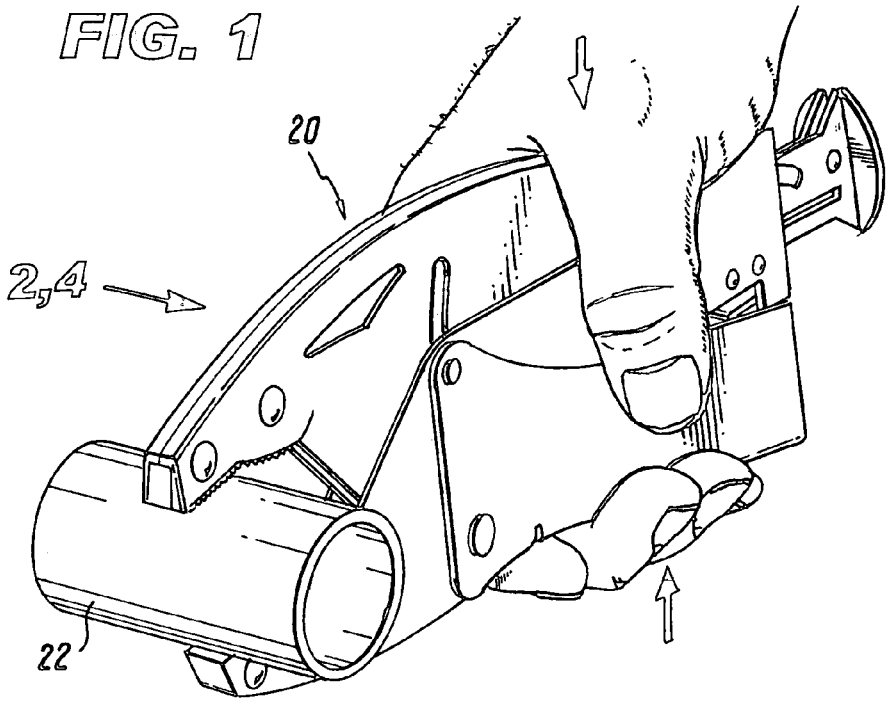
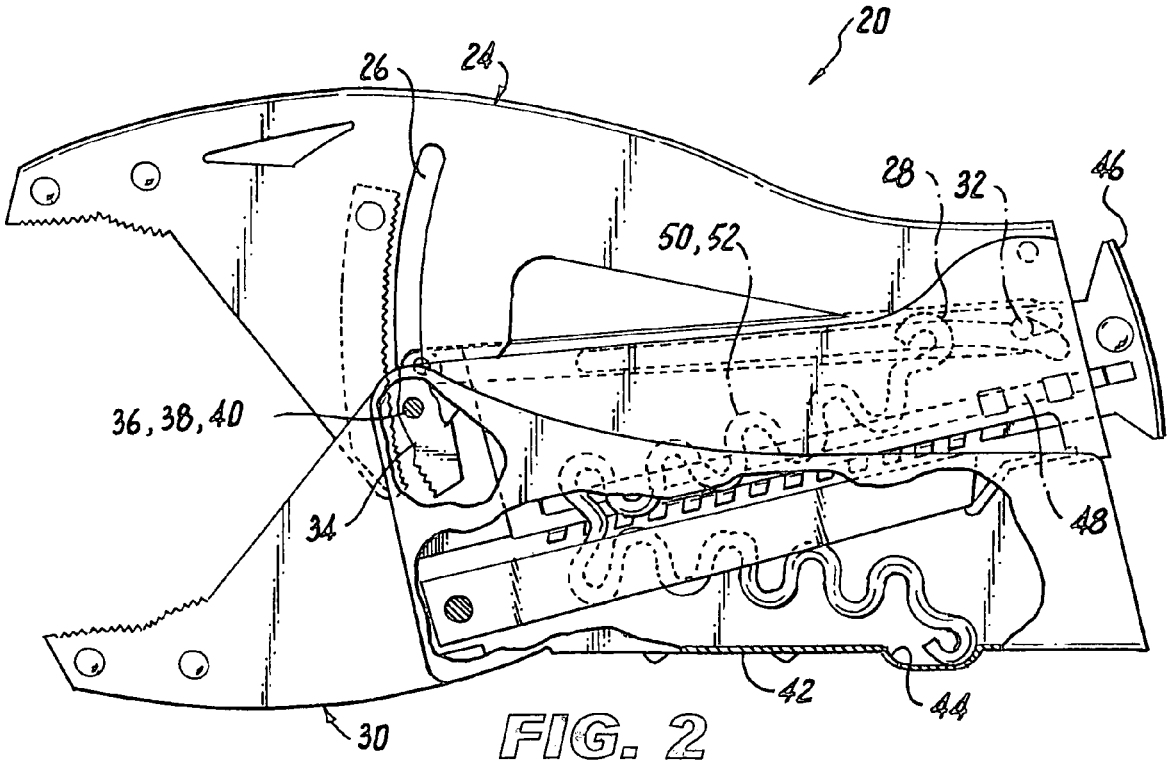
FIG. 2

20
24
30
32
34
42
46
50,52
58
64
66,68
76
80
82
118
1
2
6
7

SELF-ADJUSTING VARIABLE GRIP LOCKING PLIER FOR GRIPPING A WORKPIECE

BACKGROUND OF THE INVENTION

1. Field of the Invention

The present invention relates to a variable grip locking plier for gripping a workpiece, and more particularly, the present invention relates to a self-adjusting variable grip locking plier for gripping a workpiece.

2. Description of the Prior Art

Numerous other innovations for pliers have been provided in the prior art that will be described. Even though these innovations may be suitable for the specific individual purposes to which they address, however, they differ from the present invention.

A FIRST EXAMPLE, U.S. Pat. No. 3,379,079 to Cutter teaches a clamping apparatus comprising, in combination: first and second actuating arms; means connecting said arms together for rotating one end of each of said arms about a common axis for movement of the other ends of said arms in directions toward and away from each other; work engaging means secured on the other end of each of said arms; means mounted intermediate the ends of said arms for locking said arms relative to each other, said locking means including a toggle joint movable from an unlocked position to a locked position for forcing said arms toward one another, said arms being retained proximate each other when the toggle joint is in the locked position; said toggle joint having two end pivot pins and at least one intermediate pivot pin, and means providing equal movement of said end pivot pins relative to each other when said toggle joint is in the locked position and said arms are moved together and away from one another whereby said work engaging means will maintain the same force on any size workpiece held therein.

A SECOND EXAMPLE, U.S. Pat. No. 3,672,245 to Hoffman teaches pliers for positively gripping a selected work piece between substantially parallel gripping jaw surfaces, one of which is carried by a fixed handle, the other of which is carried by a pivoted toggle member mounted on an extension of the fixed handle for pivotal movement and adjustment toward and away from the jaw on the fixed handle, a handle pivotally connected to the toggle member and tensioning means connecting said handles and adjustment means on the fixed handle and having pivotal connection with the pivoted handle whereby the gripping effort on a selected work piece may be adjusted to secure a strong positive grip thereon without causing damage to the work piece.

A THIRD EXAMPLE, U.S. Pat. No. 5,022,290 to Duffy teaches a locking plier-wrench including a first handle member having a first jaw member lockable at a plurality of positions relative to the handle member and removable from the handle member so that a different jaw member having a different length shank may be substituted, and a second jaw member pivotally mounted on the handle member and straddling the handle member.

A FOURTH EXAMPLE, U.S. Pat. No. 5,609,080 to Flavigny teaches locking pliers including a fixed unit of generally elongate shape which forms at one end a fixed handle and at the other end a fixed jaw. A movable unit includes a movable jaw articulated to the fixed jaw, and an actuating lever of which one end is articulated to the movable jaw and the other end forms a movable handle. Also, a toggle mechanism is provided and includes a link articulated to an intermediate point of the lever and extending to a rear bearing point adjustable along the length of the fixed handle. The actuating lever crosses a straight line which joins the articulation of the movable jaw to the bearing point of the link, and the fixed handle extends substantially along a straight line joining the articulation to the bearing point.

A FIFTH EXAMPLE, U.S. Pat. No. 6,279,431 to Seber, et al. teaches a self-adjusting pliers that is operable to grasp a workpiece between an upper jaw and a lower jaw. The pliers includes an upper arm having the upper jaw and a lower arm, with the lower jaw linked to the lower arm but not integral with the lower arm. A control arm has a first end and a second end. The first end of the control arm has a first pivotable connection to the upper arm adjacent to an end of the upper arm remote from the upper jaw, and the second end of the control arm has a second pivotable connection to the lower arm at an intermediate location along the length of the lower arm. An upper control arm pivot pin provides the pivotable connection between the first end of the control arm and the upper arm, and a spring biases the control arm so as to resist rotation of the control arm about the upper control arm pivot pin. A support extends downwardly from the upper arm toward the lower arm and has a guide thereon. The lower jaw slidably engages the guide such that the lower jaw is constrained to follow the guide when the lower arm is pivoted about the upper control arm pivot pin.

A SIXTH EXAMPLE, U.S. Pat. No. 6,578,452 to Duffy teaches a vise grip locking tool which contains jaws that are capable of opening with a flick of the user's wrist. The tool comprises a first handle member, a second handle member, a lower jaw, and an upper jaw. The first handle member is pivotally attached to the lower jaw. The first end of the lower jaw is made up of four mutually interconnected sides having a guided slot extending through it. The upper jaw has an elongated shank that may slide along the guided slot of the lower jaw. A stop is present on the bottom of the shank preventing the upper jaw from escaping the guided slot. The second handle member is pivotally mounted to the lower jaw and includes a releasable lock which is made up of a spring-operated detent which engages teeth on the elongated shank.

A SEVENTH EXAMPLE, U.S. Pat. No. 6,748,829 to Seber, et al. teaches a self-adjusting pliers that is operable to grasp a workpiece between an upper jaw and a lower jaw. The pliers includes an upper arm having the upper jaw and a lower arm, with the lower jaw linked to the lower arm but not integral with the lower arm. A control arm has a first end and a second end. The first end of the control arm has a first pivotable connection to the upper arm adjacent to an end of the upper arm remote from the upper jaw, and the second end of the control arm has a second pivotable connection to the lower arm at an intermediate location along the length of the lower arm. An upper control arm pivot pin provides the pivotable connection between the first end of the control arm and the upper arm, and a spring biases the control arm so as to resist rotation of the control arm about the upper control arm pivot pin. A support extends downwardly from the upper arm toward the lower arm and has a guide thereon. The lower jaw slidably engages the guide such that the lower jaw is constrained to follow the guide when the lower arm is pivoted about the upper control arm pivot pin.

It is apparent that numerous innovations for pliers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, it is an object of the present invention to provide a self-adjusting variable grip locking plier for gripping a workpiece that avoids the disadvantages of the prior art.

Briefly stated, another object of the present invention is to provide a self-adjusting variable grip locking plier for gripping a workpiece. The plier includes a body, a handle, and a wedge. The plier is designed for extremely fast set up and for easily gripping and holding the workpiece with one hand with absolutely no adjustments ever to make, and provides a larger than ordinary jaw capacity in a very compact design. The plier grips and holds the workpiece with a light or tremendous gripping force with no adjustments ever to make with an extremely fast unlocking system, while at the same time fitting into the palm of one hand. When the workpiece is grasped, one simply ratchets the handle until the desired grip is obtained. The more times one squeezes the handle, the tighter the grip. This automatically locks the plier at the desired grip. To release the plier one simply pushes the wedge back into the body with the palm of one hand.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

FIG. 1 is a diagrammatic perspective view of the self-adjusting variable grip locking plier of the present invention gripping a workpiece;

FIG. 2 is a diagrammatic side elevational view, with parts broken away, of the self-adjusting variable grip locking plier of the present invention identified by ARROW 2 in FIG. 1 fully opened and before it is squeezed for gripping a workpiece;

LIST OF REFERENCE NUMERALS UTILIZED IN THE DRAWING

Figure 3:
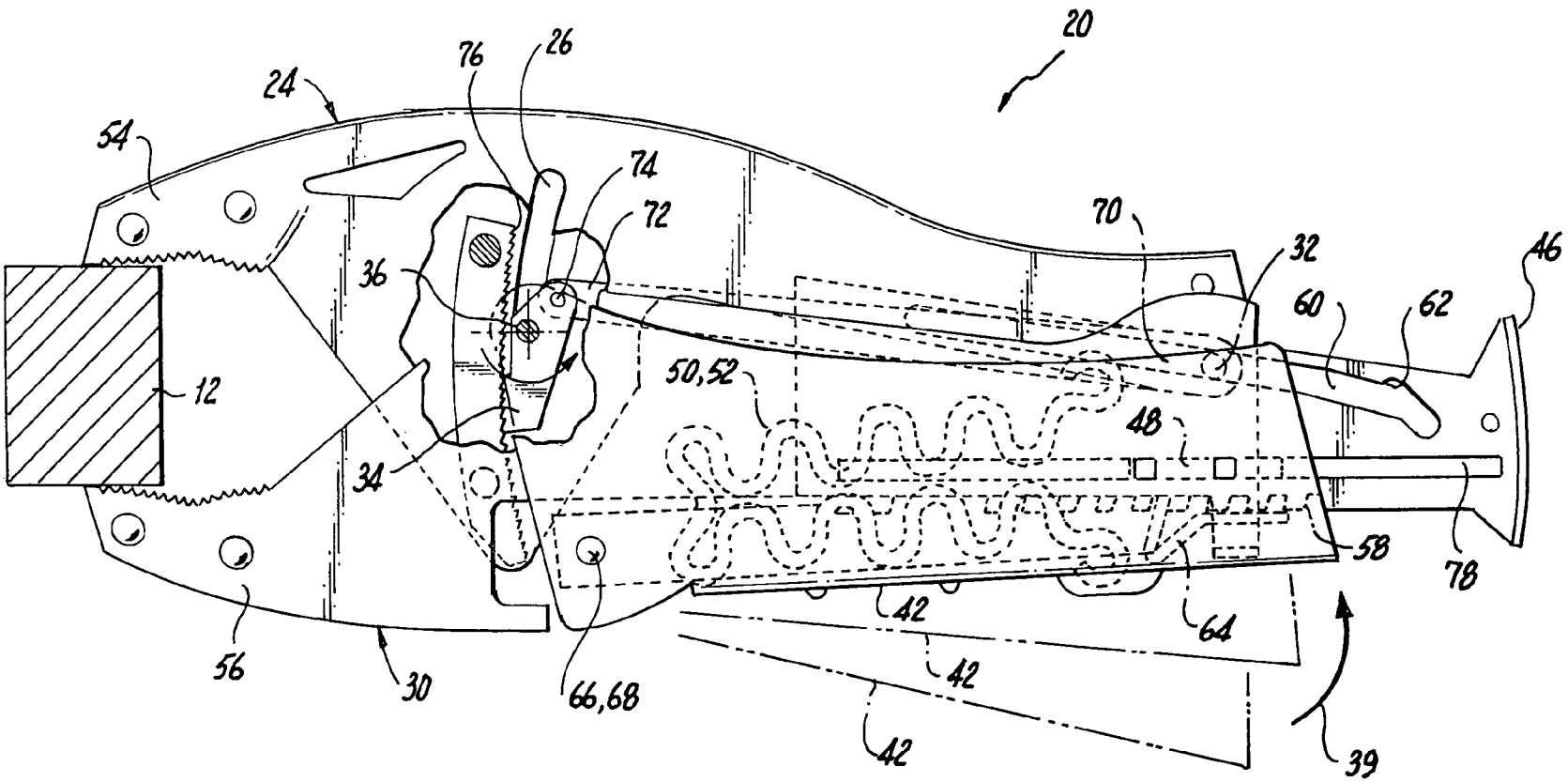
FIG. 3 is a diagrammatic side elevational view, with certain parts eliminated along with parts of the plier's frame in order to highlight the wedge and its working parts, of the self-adjusting variable grip locking plier of the present invention showing a workpiece in the process of being gripped.

20 self-adjusting variable grip locking plier of present invention for gripping workpiece 22
22 workpiece
24 upper body
26 radius channel of upper body 24
28 radius cutout of upper body 24
30 lower body
32 roller bearing
34 pawl
36 parting axle
38 stub shaft of one end of parting axle 36
40 stub shaft of other end of parting axle 36
42 ratchet handle
44 elongated depression of ratchet handle 42
46 wedge
48 guide rail
50 one mainspring
52 other mainspring
54 upper jaw
56 lower jaw 56
58 teeth of wedge 46
60 one roller bearing channel of wedge 46
61 other roller bearing channel of wedge 46
62 radius cutout hinge notch of each of one roller bearing channel 60 of wedge 46 and other roller bearing channel 61 of wedge 46
64 ratchet pawl
66 one separate flush stub shaft
68 other separate flush stub shaft
70 roller bearing channel in upper body 24
72 pawl linkage
74 wrist pin
76 fixed radius pawl track of upper body 24
78 guide channel of wedge 46
80 short and steep fifteen degree inclined seat of wedge 46
82 low sharp nine degree long angle of wedge 46
84 hinge side of ratchet pawl 64
86 tail end of ratchet pawl 64
87 one angled end stop of wedge 46
88 one ninety degree inward bent arm of lower body 30
89 other angled end stop of wedge 46
90 other ninety degree inward bent arm of lower body 30
92 rear radius curved bent around ends of wedge 46
94 bypass switch of wedge 46
96 radius cut out notch
98 upper jaw spacer
100 spacer
102 one upper body half of upper body 24
104 other upper body half of upper body 24
106 upper jaw of one upper body halve 102 of upper body 24
108 upper jaw of other upper body halve 104 of upper body 24

110 one rivet
112 other rivet
114 one flush mounted rivet
116 other flush mounted rivet
118 flush mounted rivet
120 one right angle top of upper body 24
122 other right angle top of upper body 24
124 triangular cut out eye of one upper body half 102 of upper body 24
126 triangular cut out eye of other upper body half 104 of upper body 24
128 one lower jaw of lower body 30
130 other lower jaw of lower body 30
132 lower jaw spacer of lower body 30
134 one lower body half of lower body 30
136 other lower body half of lower body 30
138 one rivet
140 other rivet
142 one radius channel of upper body 24
144 other radius channel of upper body 24
146 first rectangular slot of lower body 30
148 second rectangular slot of lower body 30
150 third rectangular slot of lower body 30
152 fourth rectangular slot of lower body 30
154 guide rail
156 one radius curved fender of lower body 30
158 other radius curved fender of lower body 30
160 one roller bearing channel in upper body 24
162 other roller bearing channel in upper body 24
164 one radius cutout in upper body 24
166 other radius cutout in upper body 24
168 upper arm of one mainsprings 50
170 upper arm of other mainspring 52
172 one wedge half of wedge 46
174 other wedge half of wedge 46
176 guide channel of one wedge half 172 of wedge 46
178 guide channel of other wedge half 174 of wedge 46
180 one flush mounted rivet
182 other flush mounted rivet
184 one spacer
186 other spacer
188 one rear end of wedge 46
190 other rear end of wedge 46
192 one extended front end of wedge 46
194 other extended front end of wedge 46
196 lower arm of one mainspring 50
198 lower arm of other mainspring 52

DETAILED DESCRIPTION OF THE PREFERRED EMBODIMENT

The present invention is a variable grip locking plier designed for extremely fast set up and for easily gripping and holding small or large objects or pieces with one hand with absolutely no adjustments ever to make for this purpose. The present invention allows for a locking plier with a larger than ordinary jaw capacity in a very compact design.

While the present invention can grip nuts and bolts, it's primarily designed for gripping when an extra hand is needed such as in welding, machine work, carpentry work, electrical work, house work, mechanic work, maintenance work, and whenever one or more objects are needed to be gripped or repaired.

The present invention offers a huge parallel jaw grip capacity with an extremely fast setup and an extremely fast release. Also, the present invention can easily be used while wearing heavy gloves, especially in jobs where working without gloves is not an option.

When an object is grasped, one simply ratchets the handle until a desired grip is obtained. The more times one squeezes the handle, the tighter is the grip. This automatically locks the plier at the desired grip. To release the present invention one simply pushes the wedge back into the plier's body with the palm of one hand. The present invention has the ability to grip and hold large objects with a light or tremendous gripping force with no adjustments ever to make and with an extremely fast unlocking system, while at the same time fitting into the palm of one hand.

Throughout time the wedge has been used to move or raise what seemed to be immovable objects. The wedge is really a fixed lever set at a low angle, which is driven between two opposed bodies forcing them apart or together. This is the principle applied to the present invention as will now be described.

Referring now to the figures, in which like numerals indicate like parts, and particularly to FIG. 1, which is a diagrammatic perspective view of the self-adjusting variable grip locking plier of the present invention gripping a workpiece, the self-adjusting variable grip locking plier of the present invention is shown generally at 20 for gripping a workpiece 22.

As shown in FIG. 2, which is a diagrammatic side elevational view, with parts broken away, of the self-adjusting variable grip locking plier of the present invention identified by ARROW 2 in FIG. 1 fully opened and before it is squeezed for gripping a workpiece, the self-adjusting variable grip locking plier 20 comprises an upper body 24 having a radius channel 26 and two halves, each of which having a radius cutout 28, a lower body 30 having two halves, a roller bearing 32, a pawl 34, and a parting axle 36 having ends with stub shafts 38 and 40 thereon, respectively.

The upper body 24 and the lower body 30 are attached at rear ends thereof by the roller bearing 32 to allow the lower body 30 to move freely in and over the upper body 24 so as to allow the pawl 34 on the parting axle 36 to float and move freely in the radius channel 26 in the upper body 24 and form an extra long radius hinge point that contributes to an almost parallel jaw grip. The parting axle 36 holds the two halves of the lower body 30 apart on the stub shafts 38 and 40 thereof while not being fixed to either half (FIG. 2).

The self-adjusting variable grip locking plier 20 further comprises a ratchet handle 42 having an elongated depression 44. The lower body 30 holds and hinges the ratchet handle 42 on the stub shafts 38 and 40 of the parting axle 36 (FIG. 2). The ratchet handle 42 is not fixed to the parting axle 36 but instead snaps onto the two separate flush stub shafts 38 and 40 of the parting axle 36 (FIG. 2).

The ratchet handle 42 is made from very thin flexible steel and bent in and narrower on a hinged end thereof to allow the ratchet handle 42 to snap onto and hold tight against the lower body 30. All other working parts of the self-adjusting variable grip locking plier 20 are held inside the upper body 24 and the lower body 30.

The self-adjusting variable grip locking plier 20 further comprises a wedge 46 and a guide rail 48. The wedge 46 is 9 degrees and is located at a rear end of the lower body 30, on the guide rail 48.

The self-adjusting variable grip locking plier 20 further comprises two mainsprings 50 and 52. The two mainsprings 50 and 52 are disposed in the upper body 24 and the lower body 30, respectively, and hold the upper body 24 and the lower body 30 apart. The two mainsprings 50 and 52 sit in the radius cutout 28 in each half of the upper body 24 and extend to the ratchet handle 42 where they sit in the elongated depression 44. Having the two mainsprings 50 and 52 set up this way balances each side of the self-adjusting variable grip locking plier 20 to prevent any side friction between the upper body 24 and the lower body 30. The radius cut outs 28 and the elongated depression 44 allow the two mainsprings 50 and 52 to shift and move freely inside the upper body 24 and the lower body 30 when contact is made with the upper body 24 by the ratchet handle 42 when using the self-adjusting variable grip locking plier 20.

The two mainsprings 50 and 52 are the only power source needed when using the self-adjusting variable grip locking plier 20 and are specifically designed for the purpose of fitting in the tightest spaces where movement is limited.

The two mainsprings 50 and 52 have horseshoe designed loops that are designed specifically to get as much spring wire in a very tight limited flat space in order to obtain as much spring flexibility as possible for the self-adjusting variable grip locking plier 20 to function.

The two mainsprings 50 and 52 hinge at a rear end of the self-adjusting variable grip locking plier 20. This puts pressure of a hand at a most forward position ahead of hinge points of the two mainsprings 50 and 52 but still allows the hand to grip from a most rear end of the self-adjusting variable grip locking plier 20 for the greatest gripping force. This allows the self-adjusting variable grip locking plier 20 to automatically center a workpiece with force before gripping.

As shown in FIG. 3, which is a diagrammatic side elevational view, with certain parts eliminated along with parts of the plier's frame in order to highlight the wedge and its working parts, of the self-adjusting variable grip locking plier of the present invention showing a workpiece in the process of being gripped, the self-adjusting variable grip locking plier 20 further comprises an upper jaw 54 and a lower jaw 56, which together have a widest opened position. The upper jaw 54 and the lower jaw 56 are radius curved to accommodate all situations of gripping with an almost parallel grip. Many other jaw designs and sizes can be easily applied to the self-adjusting variable grip locking plier 20 for any gripping situation where a fast locking grip setup is a must.

To grip something, one simply grasps the self-adjusting variable grip locking plier 20 and squeezes the upper body 24 and the lower body 30 together until the workpiece 22 makes contact with and between the upper jaw 54 and the lower jaw 56.

The wedge 46 has teeth 58 and roller bearing channels 60 and 61, each with a radius cutout hinge notch 62. The radius cutout hinge notch 62 of each of the roller bearing channels 60 and 61 of the wedge 46 hold the roller bearing 32 so as to allow the upper body 24 and the lower body 30 to hinge from the roller bearing 32.

The two mainsprings 50 and 52 push against the upper body 24 and the lower body 30 holding the wedge 46 against the roller bearing 32 in the radius cutout hinge notch 62. The radius cut out hinge notch 62 also prevents the wedge 46 from creeping rearward and away from the upper body 24 and the lower body 30, thereby keeping the wedge 46 in a neutral position when using the self-adjusting variable grip locking plier 20 before any workpiece 22 is gripped.

The self-adjusting variable grip locking plier 20 further comprises a ratchet pawl 64 and two separate flush stub shafts 66 and 68 and each half of the upper body 24 has a roller bearing channel 70 with a small angle. After contact has been made with the workpiece 22 between the upper jaw 54 and the lower jaw 56, the ratchet handle 42 automatically takes over by lowering the ratchet pawl 64, which is connected to the ratchet handle 42 by the two separate flush stub shafts 66 and 68, into the teeth 58 of the wedge 46 and then pushes the wedge 46 out and rearward away from the upper body 24 and the lower body 30. This rearward movement moves the roller bearing 32 slightly rearward in the two roller bearing channels 70 in the two halves of the upper body 24.

It's important to understand that the two roller bearing channels 70 are angled just enough to force the pawl 34 into its locked position when gripping at the widest opened position of the upper jaw 54 and the lower jaw 56.

Figure 4:
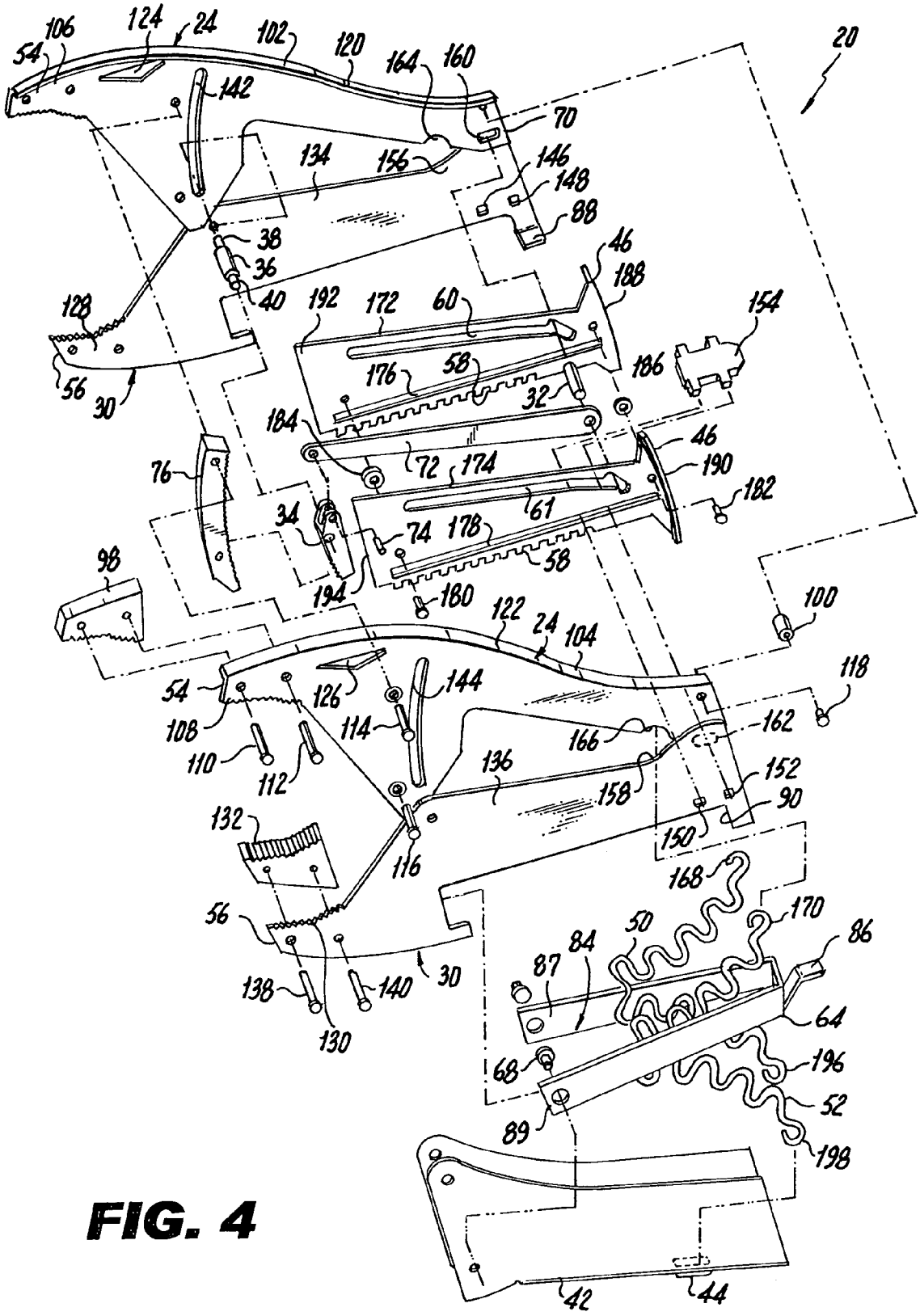
FIG. 4 is an exploded diagrammatic perspective view of the self-adjusting variable grip locking plier of the present invention identified by ARROW 4 in FIG. 1.

To better understand this, let's look at FIG. 4, which is an exploded diagrammatic perspective view of the self-adjusting variable grip locking plier of the present invention identified by ARROW 4 in FIG. 1. Notice that the angles of the two roller bearing channels 70 do not line up with the roller bearing channels 60 and 61 at the widest opened position of the upper jaw 54 and the lower jaw 56. This ensures that when the pawl 34 is activated it always moves into a locked position. Once the pawl 34 is locked it does not depend on the angle of the two roller bearing channels 70 to hold it in the locked position and stays locked from its own angled position. When gripping smaller objects this angle naturally increases.

Returning now back to FIG. 3, the self-adjusting variable grip locking plier 20 further comprises a pawl linkage 72 and a wrist pin 74, and the upper body 24 has a fixed radius pawl track 76. When the roller bearing 32 moves rearward it pulls the pawl linkage 72 that is connected thereto and sandwiched loosely between two identical halves that make up the wedge 46 and then extends to and connects to the pawl 34 on two short extended arms of the pawl 34 via the wrist pin 74. The wrist pin 74 is not fixed but instead is held in place by a side of each half of the upper body 24. This turns the pawl 34 clockwise locking the pawl 34 into a three-quarter degree spacing of the fixed radius pawl track 76 in the upper body 24. This locks the upper body 24 and the lower body 30 together at this particular position in the radius channel 26 in the upper body 24. Now the upper jaw 54 and the lower jaw 56 hinge from the parting axle 36 instead of the roller bearing 32 that is now in a fixed position in the roller bearing channels 70 in the upper body 24.

The roller bearing 32 serves four purposes. First, the roller bearing 32 is a hinge pin connecting the upper body 24 and the lower body 30 together. Second, the roller bearing 32 becomes truly a roller bearing when it rolls rearward pulling the pawl linkage 72 rearward locking the pawl 34. Third, when the pawl 34 is locked the roller bearing 32 becomes a fixed nonmovable bushing whereupon the wedge 46 slides against the roller bearing 32 expanding the rear ends of the upper body 24 and the lower body 30 increasing jaw pressure. Fourth, the roller bearing 32 pushes against the pawl linkage 72 unlocking the pawl 34 and the upper jaw 54 and the lower jaw 56.

The wedge 46 has a guide channel 78, the pawl 34 has teeth, and the fixed radius pawl track 76 has teeth. The wedge 46 is now sliding and pushing against the roller bearing 32 in the roller bearing channels 60 and 61 and against the guide rail 48 in the guide channel 78, with the guide rail 48 containing and supporting the wedge 46 in the lower body 30. This expands and forces the rear ends of the upper body 24 and the lower body 30 in opposite directions away from each other removing any slack between the teeth of the pawl 34 and the teeth of the fixed radius pawl track 76.

After this takes place, the upper jaw 54 and the lower jaw 56 are forced together. Expansion of the upper body 24 and the lower body 30 against a hinge pin forces opposite ends of the upper body 24 and the lower body 30 together from the hinge pin.

The more number of times one squeezes the ratchet handle 42 the greater a force is applied between the upper jaw 54 and the lower jaw 56 from the wedge 46. The force and grip can be a light grip or an incredibly tremendous grip force. There are absolutely no screws or adjustments to ever make on the self-adjusting variable grip locking plier 20.

Figures 5, 6, 7, 8:
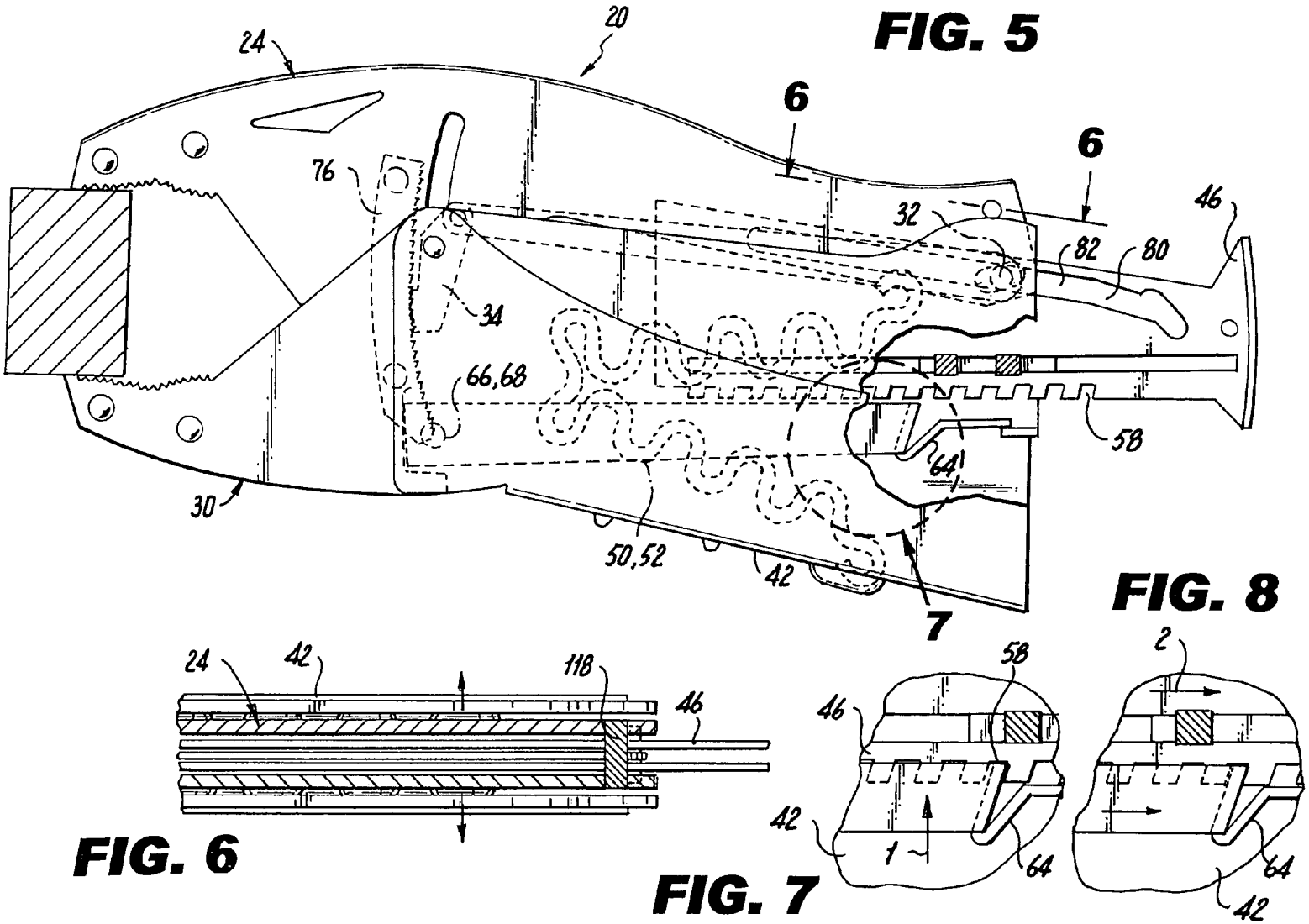
FIG. 5 is a diagrammatic side elevational view, with certain parts eliminated along with parts of the plier's frame in order to highlight the wedge and its working parts, of the self-adjusting variable grip locking plier of the present invention in its locked position and highlighting where the pawl engages the wedge mounted rack.
FIG. 6 is an enlarged diagrammatic cross sectional view, with parts broken away, taken along LINE 6-6 in FIG. 5.
FIG. 7 is an enlarged diagrammatic side elevational view, with parts broken away, of the area generally enclosed by the dotted curve identified by ARROW 7 in FIG. 5 showing the pawl after just having engaged the rack.
FIG. 8 is a diagrammatic side elevational view, with parts broken away, showing the pawl forcing the rack and wedge out of an end of the self-adjusting variable grip locking plier of the present invention.

As shown in FIGS. 5 and 6, which are, respectively, a diagrammatic side elevational view, with certain parts eliminated along with parts of the plier's frame in order to highlight the wedge and its working parts, of the self-adjusting variable grip locking plier of the present invention in its locked position and highlighting where the pawl engages the wedge mounted rack, and, an enlarged diagrammatic cross sectional view, with parts broken away, taken along LINE 6-6 in FIG. 5, the wedge 46 has a short and steep fifteen degree inclined seat 80 and a low sharp nine degree long angle 82.

When the wedge 46 is first activated its first job is to remove any slack that may be in place between the teeth of the pawl 34 and the radius pawl track 76. To accomplish this, the wedge 46 positions itself against the roller bearing 32 that is in the short and steep fifteen degree inclined seat 80 in the wedge 46 in order to expand the rear ends of the upper body 24 and the lower body 30 at a rapid geared up rate with a very short movement of the wedge 46 removing any slack between the pawl 34 and the radius pawl track 76.

After this, the wedge 46 rides against the roller bearing 32 in the low sharp nine degree long angle 82 in the wedge 46 expanding the two rear ends of the upper body 24 and the lower body 30 at a slower geared down rate. The low sharp nine degree long angle 82 in the wedge 46 also prevents the wedge 46 from moving bark to a home position inside the upper body 24 and the lower body 30 during the locking process. Also, when the wedge 46 moves rearward, the two mainsprings 50 and 52 touch and rub lightly against sides of the wedge 46 holding and stabilizing the wedge 46 especially when used in a down position preventing gravity from affecting the wedge 46 in the down position before the self-adjusting variable grip locking plier 20 is locked.

The ratchet pawl 64 has a thickness, the ratchet handle 42 has outer sides and inner sides, and the ratchet pawl 64 connects to the ratchet handle 42 with the two separate flush stub shafts 66 and 68 in the inner sides of the ratchet handle 42, respectively. The two separate flush stub shafts 66 and 68 are affixed on the outer sides of the ratchet handle 42 (FIG. 4). The ratchet pawl 64 snaps onto the two separate flush stub shafts 66 and 68. The two separate flush stub shafts 66 and 68 are only as long as the thickness of the ratchet pawl 42. This allows the ratchet pawl 64 and the two separate flush stub shafts 66 and 68 to pass over the upper body 24 (FIGS. 3 and 5) when using the self-adjusting variable grip locking plier 20.

The ratchet pawl 64 has a hinge side 84. When the ratchet handle 42 is squeezed, the ratchet pawl 64 moves as a fixed piece with the ratchet handle 42. As seen in FIG. 4, the ratchet pawl 64 is expanded and wider on the hinge side 84 thereof. Being under spring tension from its own bent body, the ratchet pawl 64 grips and tightens itself against the inner sides of the ratchet handles 42 inside the upper body 24 and the lower body 30. As shown in FIG. 7, which is an enlarged diagrammatic side elevational view, with parts broken away, of the area generally enclosed by the dotted curve identified by ARROW 7 in FIG. 5 showing the pawl after just having engaged the rack, this allows the ratchet pawl 64 to be lowered into the teeth 58 of the wedge 46 as a single unit with the ratchet handle 42 (FIG. 7, Arrow 1).

As shown in FIGS. 7 and 8, the ratchet pawl 64 moves in a rectangular silent motion when used. As shown in FIG. 8, from here the ratchet pawl 64 pushes the wedge 46 rearward (Arrow 2). After the ratchet handle 42 bottoms out and can't move any further (FIG. 3, Arrow 39), the ratchet handle 42 is released lifting the ratchet pawl 64 out and clear of the teeth 58 of the wedge 46 without ever having touched the teeth 58 of the wedge 46.

The ratchet pawl 64 has a tail end 86 and two angled end stops 87 and 89, and the lower body 30 has two ninety degree inward bent arms 88 and 90. When the ratchet handle 42 is released, outward spring tension from the ratchet pawl 64 against the inner sides of the ratchet handle 42 holds the tail end 86 of the ratchet pawl 64 against the two ninety degree inward bent arms 88 and 90 on the lower body 30 (FIG. 4) keeping the ratchet pawl 64 clear of the teeth 58 of the wedge 46 (FIG. 5) until the hinge point end of the ratchet pawl 64 stops against the two angled end stops 87 and 89 (FIG. 4) against the lower body 30. As seen from this position, the two angled end stops 87 and 89 (FIG. 4) of the ratchet pawl 64 force the ratchet pawl 64 to stay in an opened position from forces applied by the two mainsprings 50 and 52 against the ratchet handle 42 and then applied to the two angled end stops 87 and 89 of the ratchet pawl 64. This eliminates a need for extra moving parts that would be necessary to accomplish the same results.

Figure 9:
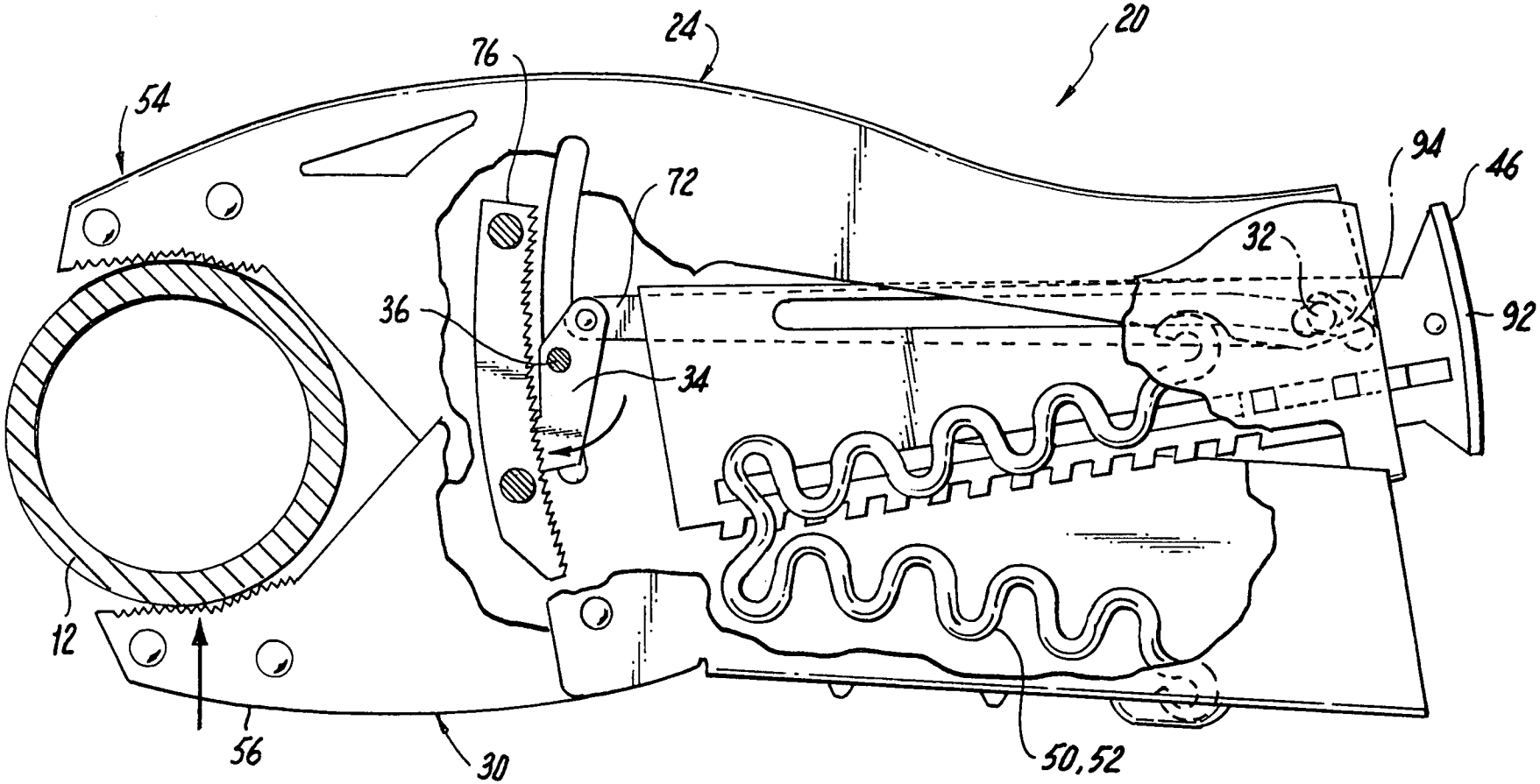
FIG. 9 is a diagrammatic side elevational view, with parts broken away, of the self-adjusting variable grip locking plier of the present invention just before being unlocked showing the wedge mounted rack partially forced back into the self-adjusting variable grip locking plier of the present invention.
Figure 10:
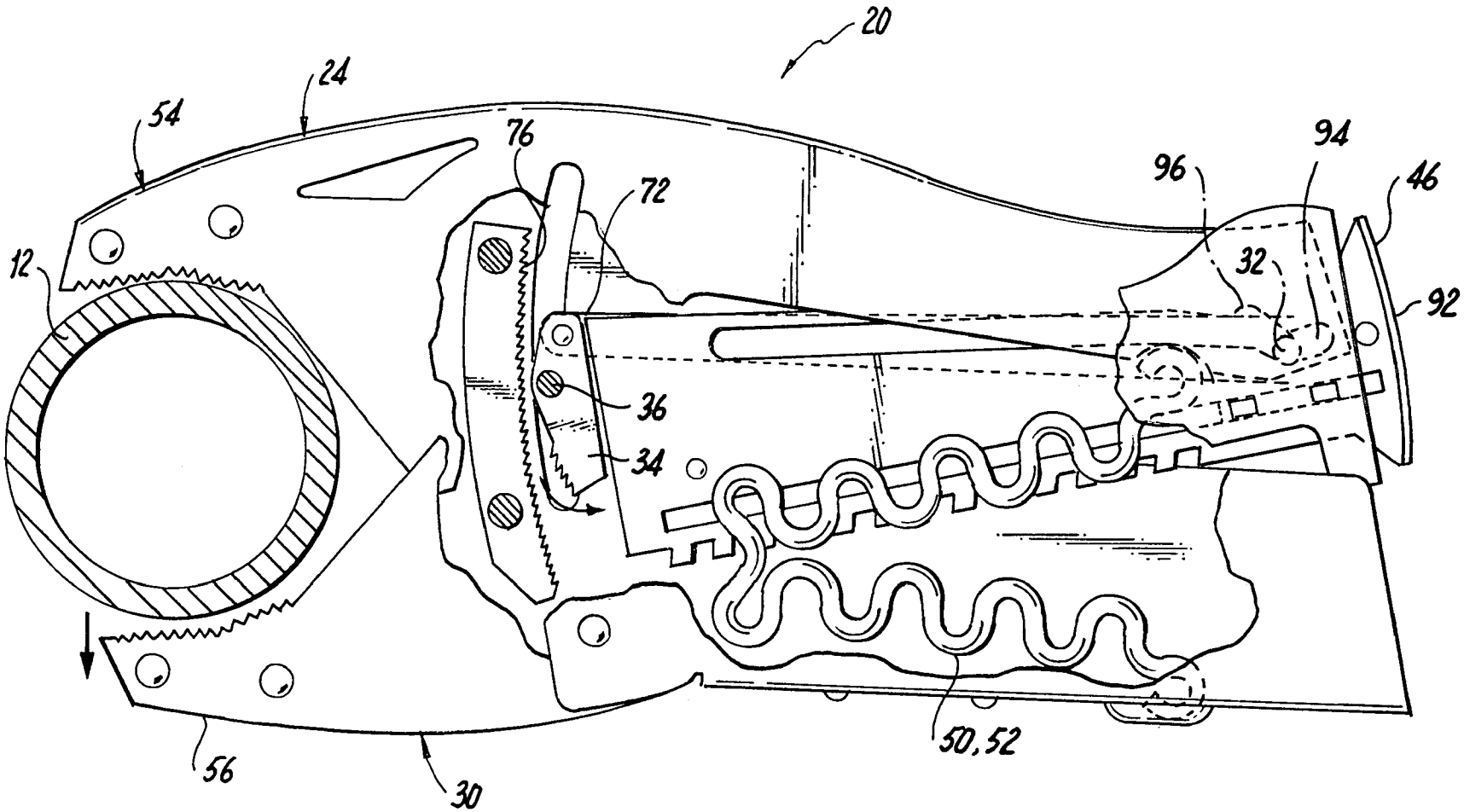
FIG. 10 is a diagrammatic side elevational view, with parts broken away, of the self-adjusting variable grip locking plier of the present invention unlocked showing the workpiece being released.

As shown in FIGS. 9 and 10, which are, respectively, a diagrammatic side elevational view, with parts broken away, of the self-adjusting variable grip locking plier of the present invention just before being unlocked showing the wedge mounted rack partially forced back into the self-adjusting variable grip locking plier of the present invention, and, a diagrammatic side elevational view, with parts broken away, of the self-adjusting variable grip locking plier of the present invention unlocked showing a workpiece being released, the wedge 46 has a low sharp angle. When the wedge 46 is locked, the only thing holding the wedge 46 in the locked position is the low sharp angle of the wedge 46.

The wedge 46 has rear radius curved bent around ends 92. To unlock the self-adjusting variable grip locking plier 20, one simply hits the rear radius curved bent around ends 92 of the wedge 46 with the palm of either hand pushing the wedge 46 into its unlocked home position. This is an extremely fast and efficient release system.

The wedge 46 contains an override bypass switch 94. It's very important to understand what happens when the rear end of the wedge 46 makes contact with the roller bearing 32. The bypass switch 94 overrides and bypasses the wedge's original get start position. Without the bypass switch 94, the pawl 34 cannot be released.

As shown in FIG. 9, when the wedge 46 is pushed forward it first makes contact against the roller bearing 32, which is connected to and pushes against the pawl linkage 72, which is attached to the pawl 34 by the wrist pin 74. As soon as the wedge 46 touches the roller bearing 32, gripping force of the self-adjusting variable grip locking plier 20 is released but the pawl 34 does not move or release at this stage of the release. At this position, the wedge 46 is now floating free around the roller bearing 32. What's happening is that the two mainsprings 50 and 52 are now pushing the upper body 24 away from the lower body 30 from the work piece 12 keeping the pawl 34 locked. The pawl 34 is on a low inward angled side of its movement from the parting axle 36 locking the pawl 34 in a seven o'clock angled position. The pawl linkage 72 is pushing against the pawl 34 but it can't unlock the pawl 34 in this position. The wedge 46 (FIG. 10) now uses the specially designed override by the bypass switch 94 to overcome this by moving against the roller bearing 32 along its steep angled end. This pulls the upper body 24 and the lower body 30 together pulling the lower jaw 56 away from the work piece 22. This allows the wedge 46 to then bottom out against the roller bearing 32 now pushing against the pawl linkage 72 turning the pawl 34 counterclockwise unlocking the pawl 34 from the radius pawl track 76 of the upper body 24 forcing the pawl 34 into a five o'clock unlocked position.

The pawl linkage 72 serves two purposes. First, the pawl linkage 72 is a stretcher to lock the pawl 34. Second, then it's a push rod to unlock the pawl 34. When the wedge 46 is released, the two mainsprings 50 and 52 slide the wedge 46 into its original start position in a radius cut out notch 96 and then the upper body 24 and the lower body 30 automatically move away from each other returning back into their original opened unlocked home position, with the upper jaw 54 and the lower jaw 56 ready to grip a new workpiece 22.

The self-adjusting variable grip locking plier 20 is 6" long, has a 3" jaw capacity, is stamped from 0.075 sheet steel, and is held together with rivets.

Returning now back to FIG. 4, the self-adjusting variable grip locking plier 20 comprises an upper jaw spacer 98 and a spacer 100, and the upper body 24 has a height. The self-adjusting variable grip locking plier 20 gets its strength from the height of the upper body 24 allowing it to be made up of two upper body halves 102 and 104 having upper jaws 106 and 108, respectively.

Sandwiched between the upper jaws 106 and 108 of the upper body 24 is the upper jaw spacer 98, which are held together with rivets 110 and 112. Also sandwiched between the upper body 24 is the fixed radius pawl track 76 held with flush mounted rivets 114 and 116. The flush mounted rivets 114 and 116 allow the lower body 30 to move over the upper body 24. A flush mounted rivet 118 with the spacer 100 hold the rear end of the upper body 24 together.

The upper body 24 has right angles tops 120 and 122 in order to cap the inner sides of the upper body 24. The two halves 102 and 104 of the upper body 24 have triangular cut out eyes 124 and 126, respectively, that are strictly decorative representing eyes of the self-adjusting variable grip locking plier 20.

The lower body 30 has lower jaws 128 and 130 and a lower jaw spacer 132, and is made up of two lower body halves 134 and 136. Sandwiched between the lower jaws 128 and 130 of the lower body 30 is the lower jaw spacer 132, which are held together with rivets 138 and 140. Unlike the upper body 24, the lower jaws 128 and 130 are bent and angled inward to form a thinner jaw width than that of the lower body 30. This matches the jaw width of the upper body 24.

The upper body 24 has radius channels 142 and 144. The two separate flush stub shafts 38 and 40 on the ends of the parting axle 36, respectively, hold the two body halves 134 and 136 apart from each other but are not fixed to either half. The parting axle 36 holds the lower body 30 to the upper body 24 in the radius channels 142 and 144. The pawl 34 hinges on the parting axle 36.

The self-adjusting variable grip locking plier 20 further comprises a guide rail 154, and the lower body 30 has four rectangular slots 146, 148, 150, and 152. The guide rail 154 holds the two rear ends of the lower body 30 together by being flush through the four rectangular slots 146, 148, 150, and 152 in the lower body 30.

The lower body 30 has two radius curved fenders 156 and 158, the upper body 24 has roller bearing channels 160 and 162 and radius cutouts 164 and 166, and the two mainsprings 50 and 52 have upper arms 168 and 170, respectively. The two radius curved fenders 156 and 158 at the rear ends of the lower body 30 keep the roller bearing 32 contained in the upper body 24 in the roller bearing channels 160 and 162 when the wedge 46 is fully extended. The two radius curved fenders 156 and 158 also contain the upper arms 168 and 170 of the two mainsprings 50 and 52 in the radius cutouts 164 and 166 in the upper body 24, respectively, when the wedge 46 is fully extended. But most importantly, the two radius curved fenders 156 and 158 apply pressure to the upper jaw 54 and the lower jaw 56 directly from the palm of the hand when gripping. This prevents the self-adjusting variable grip locking plier 20 from gripping too early in the gripping process.

When the two radius curved fenders 156 and 158 press against the palm of the hand when gripping, which is inescapable when gripping, the grip force is automatically applied greater to the upper jaw 54 and the lower jaw 56 by preventing the wedge 46 from moving too early before the final gripping process. This applies greater pressure to the upper jaw 54 and the lower jaw 56.

The wedge 46 is made up of two wedge halves 172 and 174 that have guide channels 176 and 178, respectively. When gripping, the longer it takes before the wedge 46 is activated, the tighter the grip on the workpiece 22. This makes sure that the wedge 46 is doing its job at its fullest potential. The two wedge halves 172 and 174 fit and slide on the guide rail 154 through the guide channels 176 and 178.

The two wedge halves 172 and 174 are held together with two flush mounted rivets 180 and 182 along with spacers 184 and 186. The spacers 184 and 186 allow the pawl linkage 72 to move freely between the two wedge halves 172 and 174. The wedge 46 has rear ends 188 and 190 that are bent around to soften contact with the palm of the hand when released.

The wedge 46 has extended front ends 192 and 194. The extended front ends 192 and 194 of the wedge 46 are used to make sure that the upper arms 168 and 170 of the two mainsprings 50 and 52 stay contained in the radius cutouts 164 and 166 in the upper body 24 when the wedge 46 is fully extended.

The pawl linkage 72 fits loosely between the two wedge halves 172 and 174 and is connected to the roller bearing 32 in the roller bearing channels 60 and 61. From here the pawl linkage 72 extends and connects to and between the two short extended arms of the pawl 34 with the wrist pin 74.

Like the parting axle 36, the roller bearing 32 connects the lower body 30 to the upper body 24. The roller bearing channels 160 and 162 in the upper body 24 hold the roller bearing 32 in the upper body 24. From here the wedge 46 is held inside the two halves 102 and 104 of the upper body 24, with the roller bearing 32 through the roller bearing channels 60 and 61 in the wedge 46.

The ratchet pawl 64 fits inside the ratchet handle 42 on the two separate flush stub shafts 66 and 68. The hinged side 84 of the ratchet pawl 64 is bent out to keep it in a semi fixed position in the ratchet handle 42.

The two mainsprings 50 and 52 have lower arms 196 and 198, respectively. The lower arms 196 and 198 of the two mainsprings 50 and 52, respectively, are positioned in the elongated depression 44 in the ratchet handle 42. To connect the ratchet handle 42 to the upper body 24 and the lower body 30 one simply positions the tail end 86 of the ratchet pawl 64 under the two ninety degree inward bent arms 88 and 90 on the lower body 30, then slide the ratchet handle 42 over the lower body 30, and simply snap the ratchet handle 42 onto the two separate flush stub shafts 38 and 40 on the parting axle 36.

It will be understood that each of the elements described above, or two or more together, may also find a useful application in other types of constructions differing from the types described above.

While the invention has been illustrated and described as embodied in a self-adjusting variable grip locking plier, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-adjusting variable grip locking plier for gripping a workpiece, comprising:

a) a lower body;

b) an upper body;

c) a handle; and d) a wedge;

wherein said lower body, said upper body, said handle, and said wedge are operatively connected to each other so as to allow said plier to automatically lock at a desired grip with no adjustments ever to make when an object is grasped by simply ratcheting said handle until the desired grip is obtained, and to release said plier said wedge is pushed back into said lower body and said upper body with the palm of one hand;

wherein said upper body has a radius channel;

wherein said upper body has two halves;

wherein each half of said upper body has a radius cutout;

wherein said lower body has two halves.

2. The plier of claim 1, further comprising a roller bearing.

3. The plier of claim 2, further comprising a pawl.

4. The plier of claim 3, further comprising a parting axle.

5. The plier of claim 4, wherein said parting axle has ends; and wherein said ends of said parting axle have stub shafts thereon, respectively.

6. The plier of claim 5, wherein said upper body and said lower body are attached at rear ends thereof by said roller bearing to allow said lower body to move freely in and over said upper body to allow said pawl on said parting axle to float and move freely in said radius channel in said upper body and form an extra long radius hinge point that contributes to an almost parallel jaw grip.

7. The plier of claim 6, wherein said parting axle holds said two halves of said lower body apart on said stub shafts thereof while not being fixed to either half.

8. The plier of claim 7, wherein a ratchet handle has an elongated depression.

9. The plier of claim 8, wherein said lower body holds and hinges said ratchet handle on said stub shafts of said parting axle.

10. The plier of claim 9, wherein said ratchet handle is not fixed to said parting axle but instead snaps onto said two separate flush stub shafts of said parting axle.

11. The plier of claim 10, wherein said ratchet handle is made from very thin flexible steel.

12. The plier of claim 11, wherein said ratchet handle is bent in and narrower on a hinged end thereof to allow said ratchet handle to snap onto and hold tight against said lower body.

13. The plier of claim 12, further comprising a guide rail.

14. The plier of claim 13, wherein said wedge is located at a rear end of said lower body, on said guide rail.

15. The plier of claim 14, wherein said wedge is 9 degrees.

16. The plier of claim 15, further comprising two mainsprings.

17. The plier of claim 16, wherein said two mainsprings are disposed in said upper body and said lower body.

18. The plier of claim 17, wherein said two mainsprings hold said upper body and said lower body apart.

19. The plier of claim 18, wherein said two mainsprings sit in said radius cutout in each half of said upper body, extend to said ratchet handle, and sit in said elongated depression to balance each side of said plier to prevent any side friction between said upper body and said lower body.

20. The plier of claim 19, wherein said radius cut outs and said elongated depression allow said two mainsprings to shift and move freely inside said upper body and said lower body when contact is made by said ratchet handle with said upper body when using said plier.

21. The plier of claim 20, wherein said two mainsprings have horseshoe designed loops that are designed specifically to get as much spring wire in a very tight limited flat space in order to obtain as much spring flexibility as possible for said plier to function.

22. The plier of claim 21, wherein said two mainsprings hinge at a rear end of said plier to put pressure of a hand at a most forward position ahead of hinge points of said two mainsprings but still allow the hand to grip from a most rear end of said plier for greatest gripping force to allow said plier to automatically center the workpiece with force before gripping.

23. The plier of claim 22, further comprising an upper jaw.

24. The plier of claim 23, further comprising a lower jaw; and wherein said upper jaw and said lower jaw together have a widest opened position.

25. The plier of claim 24, wherein said upper jaw and said lower jaw are radius curved to accommodate all situations of gripping with an almost parallel grip.

26. The plier of claim 25, wherein to grip something, one simply grasps said plier and squeezes said upper body and said lower body together until contact is made by the workpiece between and with said upper jaw and said lower jaw.

27. The plier of claim 26, wherein said wedge has teeth.

28. The plier of claim 27, wherein said wedge has roller bearing channels.

29. The plier of claim 28, wherein each of said roller bearing channels of said wedge has a radius cutout hinge notch.

30. The plier of claim 29, wherein said radius cutout hinge notches of said roller bearing channels of said wedge hold said roller bearing to allow said upper body and said lower body to hinge from said roller bearing.

31. The plier of claim 30, wherein said two mainsprings push against said upper body and said lower body holding said wedge against said roller bearing in said radius cutout hinge notches.

32. The plier of claim 31, wherein said radius cut out hinge notches prevent said wedge from creeping rearward and away from said upper body and said lower body, thereby keeping said wedge in a neutral position when using said plier before any workpiece is gripped.

33. The plier of claim 32, further comprising a ratchet pawl.

34. The plier of claim 33, further comprising two separate flush stub shafts.

35. The plier of claim 34, wherein each half of said upper body has a roller bearing channel.

36. The plier of claim 35, wherein said roller bearing channel of each half of said upper body has a small angle.

37. The plier of claim 36, wherein after contact has been made with the workpiece by and between said upper jaw and said lower jaw, said ratchet handle automatically takes over by lowering said ratchet pawl, which is connected to said ratchet handle by said two separate flush stub shafts, into said teeth of said wedge and then pushes said wedge out and rearward away from said upper body and said lower body to move said roller bearing slightly rearward in said two roller bearing channels in said two halves of said upper body.

38. The plier of claim 37, wherein said two roller bearing channels are angled just enough to force said pawl into its locked position when gripping at said widest opened position of said upper jaw and said lower jaw.

39. The plier of claim 38, wherein said angles of said two roller bearing channels do not line up with said roller bearing channels at said widest opened position of said upper jaw and said lower jaw to ensure that when said pawl is activated it always moves into a locked position.

40. The plier of claim 39, wherein once said pawl is locked it does not depend on said angle of said two roller bearing channels to hold it in said locked position.

41. The plier of claim 40, wherein once said pawl is locked it stays locked from its own angled position.

42. The plier of claim 41, further comprising a pawl linkage.

43. The plier of claim 42, further comprising a wrist pin.

44. The plier of claim 43, wherein said upper body has a fixed radius pawl track.

45. The plier of claim 44, wherein when said roller bearing moves rearward it pulls said pawl linkage, which is connected thereto and sandwiched loosely between two identical halves that make up said wedge, and then extends to and connects to said pawl on two short extended arms of said pawl via said wrist pin.

46. The plier of claim 45, wherein said wrist pin is not fixed but instead is held in place by a side of each half of said upper body, which turns said pawl clockwise locking said pawl into a three-quarter degree spacing of said fixed radius pawl track in said upper body to lock said upper body and said lower body together at this particular position in said radius channel in said upper body causing said upper jaw and said lower jaw to hinge from said parting axle instead of said roller bearing, which is now in a fixed position in said roller bearing channels in said upper body.

47. The plier of claim 46, wherein said roller bearing is a hinge pin connecting said upper body and said lower body together.

48. The plier of claim 47, wherein said roller bearing rolls rearward pulling said pawl linkage rearward locking said pawl.

49. The plier of claim 48, wherein when said pawl is locked said roller bearing becomes a fixed nonmovable bushing whereupon said wedge slides against said roller bearing expanding said rear ends of said upper body and said lower body increasing jaw pressure.

50. The plier of claim 49, wherein said roller bearing pushes against said pawl linkage unlocking said pawl and said upper jaw and said lower jaw.

51. The plier of claim 50, wherein said wedge has a guide channel.

52. The plier of claim 51, wherein said pawl has teeth.

53. The plier of claim 52, wherein said fixed radius pawl track has teeth.

54. The plier of claim 53, wherein said wedge slides and pushes against said roller bearing in said roller bearing channels and against said guide rail in said guide channel, with said guide rail containing and supporting said wedge in said lower body to expand and force said rear ends of said upper body and said lower body in opposite directions away from each other removing any slack between said teeth of said pawl and said teeth of said fixed radius pawl track.

55. The plier of claim 54, wherein expansion of said upper body and said lower body against a hinge pin forces opposite ends of said upper body and said lower body together from said hinge pin.

56. The plier of claim 55, wherein more number of times one squeezes said ratchet handle the greater a force is applied between said upper jaw and said lower jaw from said wedge.

57. The plier of claim 56, wherein said wedge has a short and steep fifteen degree inclined seat.

58. The plier of claim 57, wherein said wedge has a low sharp nine degree long angle.

59. The plier of claim 58, wherein when said wedge is first activated it removes any slack that may be in place between said teeth of said pawl and said radius pawl track by positioning itself against said roller bearing that is in said short and steep fifteen degree inclined seat in said wedge in order to expand said rear ends of said upper body and said lower body at a rapid geared up rate with a very short movement of said wedge.

60. The plier of claim 59, wherein said wedge rides against said roller bearing in said low sharp nine degree long angle in said wedge expanding said two rear ends of said upper body and said lower body at a slower geared down rate.

61. The plier of claim 60, wherein said low sharp nine degree long angle in said wedge prevents said wedge from moving bark to a home position inside said upper body and said lower body during locking.

62. The plier of claim 61, wherein when said wedge moves rearward, said two mainsprings touch and rub lightly against sides of said wedge holding and stabilizing said wedge, especially when used in a down position preventing gravity from affecting said wedge in said down position before said plier is locked.

63. The plier of claim 62, wherein said ratchet handle has outer sides and inner sides;

wherein said ratchet pawl has a thickness; and wherein said ratchet pawl connects to said ratchet handle, with said two separate flush stub shafts in said inner sides of said ratchet handle, respectively.

64. The plier of claim 63, wherein said two separate flush stub shafts are affixed on said outer sides of said ratchet handle.

65. The plier of claim 64, wherein said ratchet pawl snaps onto said two separate flush stub shafts.

66. The plier of claim 65, wherein said two separate flush stub shafts are only as long as said thickness of said ratchet pawl so as to allow said ratchet pawl and said two separate flush stub shafts to pass over said upper body when using said plier.

67. The plier of claim 66, wherein when said ratchet handle is squeezed, said ratchet pawl moves as a fixed piece with said ratchet handle.

68. The plier of claim 67, wherein said ratchet pawl has a hinge side; and wherein said ratchet pawl is expanded and wider on said hinge side thereof.

69. The plier of claim 68, wherein being under spring tension from its own bent body, said ratchet pawl grips and tightens itself against said inner sides of said ratchet handles inside said upper body and said lower body to allow said ratchet pawl to be lowered into said teeth of said wedge as a single unit with said ratchet handle.

70. The plier of claim 69, wherein said ratchet pawl moves in a rectangular silent motion when used.

71. The plier of claim 70, wherein said ratchet pawl pushes said wedge rearward and after said ratchet handle bottoms out and can't move any further, said ratchet handle is released lifting said ratchet pawl out and clear of said teeth of said wedge without ever having touched said teeth of said wedge.

72. The plier of claim 71, wherein said ratchet pawl has a tail end.

73. The plier of claim 72, wherein said ratchet pawl has two angled end stops.

74. The plier of claim 73, wherein said lower body has two ninety degree inward bent arms.

75. The plier of claim 74, wherein when said ratchet handle is released, outward spring tension from said ratchet pawl against said inner sides of said ratchet handle holds said tail end of said ratchet pawl against said two ninety degree inward bent arms on said lower body keeping said ratchet pawl clear of said teeth of said wedge until said hinge point end of said ratchet pawl stops against said two angled end stops against said lower body.

76. The plier of claim 75, wherein said two angled end stops of said ratchet pawl force said ratchet pawl to stay in an opened position from forces applied by said two mainsprings against said ratchet handle and then applied to said two angled end stops of said ratchet pawl to eliminate a need for extra moving parts that would be necessary to accomplish the same results.

77. The plier of claim 76, wherein said wedge has a low sharp angle; and wherein when said wedge is locked, the only thing holding said wedge in said locked position is said low sharp angle of said wedge.

78. The plier of claim 77, wherein said wedge has rear radius curved bent around ends.

79. The plier of claim 78, wherein to unlock said plier, one simply hits said rear radius curved bent around ends of said wedge with the palm of either hand pushing said wedge into its unlocked home position.

80. The plier of claim 79, wherein said wedge contains an override bypass switch.

81. The plier of claim 80, wherein said bypass switch overrides and bypasses said wedge's original get start position, and without said bypass switch, said pawl cannot be released.

82. The plier of claim 81, wherein when said wedge is pushed forward it first makes contact against said roller bearing, which is connected to and pushes against said pawl linkage, which is attached to said pawl by said wrist pin.

83. The plier of claim 82, wherein as soon as said wedge touches said roller bearing, gripping force of said plier is released but said pawl does not move or release at this stage of release and said wedge is now floating free around said roller bearing by virtue of said two mainsprings now pushing said upper body away from said lower body from the workpiece keeping said pawl locked.

84. The plier of claim 83, wherein said pawl is on a low inward angled side of its movement from said parting axle locking said pawl in a seven o'clock angled position and said pawl linkage is pushing against said pawl but it can't unlock said pawl in this position, said wedge now uses said override bypass switch to overcome this by moving against said roller bearing along its steep angled end to pull said upper body and said lower body together pulling said lower jaw away from the workpiece to allow said wedge to then bottom out against said roller bearing now pushing against said pawl linkage turning said pawl counterclockwise unlocking said pawl from said radius pawl track of said upper body forcing said pawl into a five o'clock unlocked position.

85. The plier of claim 84, wherein said pawl linkage is a stretcher to lock said pawl; and wherein said pawl linkage is a push rod to unlock said pawl.

86. The plier of claim 85, wherein when said wedge is released, said two mainsprings slide said wedge into its original start position in a radius cut out notch and then said upper body and said lower body automatically move away from each other returning back into their original opened unlocked home position, with said upper jaw and said lower jaw ready to grip a new workpiece.

87. The plier of claim 86, further comprising an upper jaw spacer.

88. The plier of claim 87, further comprising a spacer.

89. The plier of claim 88, wherein said upper body is made up of two upper body halves.

90. The plier of claim 89, wherein said two upper body halves have upper jaws, respectively.

91. The plier of claim 90, wherein said upper jaw spacer is sandwiched between said upper jaws of said two upper body halves of said upper body.

92. The plier of claim 91, wherein said upper jaw spacer and said upper jaws of said two upper body halves of said upper body are held together with rivets.

93. The plier of claim 92, wherein said fixed radius pawl track is sandwiched between said two upper body halves of said upper body.

94. The plier of claim 93, wherein said fixed radius pawl track and said two upper body halves of said upper body are held with flush mounted rivets.

95. The plier of claim 94, wherein said flush mounted rivets allow said lower body to move over said upper body.

96. The plier of claim 95, wherein a flush mounted rivet with said spacer hold said rear end of said upper body together.

97. The plier of claim 96, wherein said upper body has right angles tops in order to cap said inner sides of said upper body.

98. The plier of claim 97, wherein said two halves of said upper body have triangular cut out eyes, respectively.

99. The plier of claim 98, wherein said lower body has lower jaws.

100. The plier of claim 99, wherein said lower body has a lower jaw spacer.

101. The plier of claim 100, wherein said lower body is made up of two lower body halves.

102. The plier of claim 101, wherein said lower jaw spacer is sandwiched between said lower jaws of said lower body.

103. The plier of claim 102, wherein said lower jaw spacer and said lower jaws of said lower body are held together with rivets.

104. The plier of claim 103, wherein said lower jaws are bent and angled inward to form a thinner jaw width than that of said lower body to match said jaw width of said upper body.

105. The plier of claim 104, wherein said upper body has radius channels.

106. The plier of claim 105, wherein said two separate flush stub shafts on said ends of said parting axle respectively, hold said two body halves apart from each other but are not fixed to either half.

107. The plier of claim 106, wherein said parting axle holds said lower body to said upper body in said radius channels.

108. The plier of claim 107, wherein said pawl hinges on said parting axle.

109. The plier of claim 108, wherein said lower body has four rectangular slots.

110. The plier of claim 109, wherein a guide rail holds said two rear ends of said lower body together by being flush through said four rectangular slots in said lower body.

111. The plier of claim 110, wherein said lower body has two radius curved fenders.

112. The plier of claim 111, wherein said upper body has roller bearing channels.

113. The plier of claim 112, wherein said upper body has radius cutouts.

114. The plier of claim 113, wherein said two mainsprings have upper arms, respectively.

115. The plier of claim 114, wherein said two radius curved fenders at said rear ends of said lower body keep said roller bearing contained in said upper body in said roller bearing channels when said wedge is fully extended.

116. The plier of claim 115, wherein said two radius curved fenders contain said upper arms of said two mainsprings in said radius cutouts in said upper body, respectively, when said wedge is fully extended.

117. The plier of claim 116, wherein said two radius curved fenders apply pressure to said upper jaw and said lower jaw directly from the palm of the hand when gripping to prevent said plier from gripping too early in the gripping process.

118. The plier of claim 117, wherein when said two radius curved fenders press against the palm of the hand when gripping, which is inescapable when gripping, the grip force is automatically applied greater to said upper jaw and said lower jaw by preventing said wedge from moving too early before the final gripping process to apply greater pressure to said upper jaw and said lower jaw.

119. The plier of claim 118, wherein said wedge is made up of two wedge halves.

120. The plier of claim 119, wherein said wedge has guide channels.

121. The plier of claim 120, wherein said two wedge halves fit and slide on said guide rail through said guide channels.

122. The plier of claim 121, wherein said two wedge halves are held together with two flush mounted rivets along with spacers.

123. The plier of claim 122, wherein said spacers allow said pawl linkage to move freely between said two wedge halves.

124. The plier of claim 123, wherein said wedge has rear ends; and wherein said rear ends of said wedge are bent around to soften contact with the palm of the hand when released.

125. The plier of claim 124, wherein said wedge has extended front ends.

126. The plier of claim 125, wherein said extended front ends of said wedge make sure that said upper arms of said two mainsprings stay contained in said radius cutouts in said upper body when said wedge is fully extended.

127. The plier of claim 126, wherein said pawl linkage fits loosely between said two wedge halves, is connected to said roller bearing in said roller bearing channels, and extends and connects to and between said two short extended arms of said pawl with said wrist pin.

128. The plier of claim 127, wherein said roller bearing, like said parting axle, connects said lower body to said upper body.

129. The plier of claim 128, wherein said roller bearing channels in said upper body hold said roller bearing in said upper body.

130. The plier of claim 129, wherein said wedge is held inside said two halves of said upper body, with said roller bearing being through said roller bearing channels in said wedge.

131. The plier of claim 130, wherein said ratchet pawl fits inside said ratchet handle on said two separate flush stub shafts.

132. The plier of claim 131, wherein said hinged side of said ratchet pawl is bent out to keep it in a semi fixed position in said ratchet handle.

133. The plier of claim 132, wherein said two mainsprings have lower arms, respectively.

134. The plier of claim 133, wherein said lower arms of said two mainsprings are positioned in said elongated depression in said ratchet handle.

135. The plier of claim 134, wherein to connect said ratchet handle to said upper body and said lower body one simply positions said tail end of said ratchet pawl under said two ninety degree inward bent arms on said lower body and then slides said ratchet handle over said lower body and simply snaps said ratchet handle onto said two separate flush stub shafts on said parting axle.

* * * * *